US011035290B2

(12) United States Patent
Mori et al.

(10) Patent No.: US 11,035,290 B2
(45) Date of Patent: Jun. 15, 2021

(54) INTERNAL COMBUSTION ENGINE

(71) Applicant: HONDA MOTOR CO., LTD, Tokyo (JP)

(72) Inventors: Kensuke Mori, Wako (JP); Yoshitaka Nukada, Wako (JP); Yudai Hirose, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/502,145

(22) Filed: Jul. 3, 2019

(65) Prior Publication Data

US 2020/0011235 A1 Jan. 9, 2020

(30) Foreign Application Priority Data

Jul. 6, 2018 (JP) ..... JP2018-129366

(51) Int. Cl.

| | |
|---|---|
| ***F02B 61/02*** | (2006.01) |
| ***F02B 75/20*** | (2006.01) |
| *F02F 1/24* | (2006.01) |
| *F02B 75/18* | (2006.01) |
| *F02B 75/02* | (2006.01) |

(52) U.S. Cl.

CPC ..... *F02B 61/02* (2013.01); *F02B 75/20* (2013.01); *F02B 2075/027* (2013.01); *F02B 2075/1816* (2013.01); *F02B 2275/18* (2013.01); *F02F 2001/245* (2013.01)

(58) Field of Classification Search

CPC ..... F02B 61/02; F02B 75/20; F02B 2075/02; F02B 2075/027

USPC ..... 123/179.25

See application file for complete search history.

(56) References Cited

U.S. PATENT DOCUMENTS

| | | | | |
|---|---|---|---|---|
| 4,848,170 | A | 7/1989 | Inagaki et al. | |
| 6,202,499 | B1 * | 3/2001 | Brinn | F16D 25/082 74/329 |
| 9,150,269 | B2 | 10/2015 | Ozaki et al. | |
| 9,638,156 | B2 | 5/2017 | Shiraishi | |

(Continued)

FOREIGN PATENT DOCUMENTS

| | | | |
|---|---|---|---|
| CN | 203189178 | U | 9/2013 |
| EP | 1 394 382 | B1 | 10/2007 |

(Continued)

OTHER PUBLICATIONS

Official Communication dated Mar. 25, 2020 issued in the corresponding Japanese Patent Application 2018-129366.

(Continued)

*Primary Examiner* — John Kwon
*Assistant Examiner* — Johnny H Hoang
(74) *Attorney, Agent, or Firm* — Carrier Blackman & Associates, P.C.; Joseph P. Carrier; Jeffrey T. Gedeon

(57) ABSTRACT

An internal combustion engine includes a reduction gear including: at one end thereof, a small-diameter gear in mesh with a one-way clutch gear; and at an opposite end thereof, a large-diameter gear in mesh with a drive gear of a starter motor. The starter motor has a driveshaft disposed below a rotation axis of the reduction gear and within a width of the large-diameter gear as viewed in an axial direction. Accordingly, in the internal combustion engine, it is possible to efficiently dispose components in a reentrant space formed between a crankcase and a cylinder block.

12 Claims, 7 Drawing Sheets

(56) References Cited

U.S. PATENT DOCUMENTS

| | | | | |
|---|---|---|---|---|
| 10,473,082 | B2 | 11/2019 | Nishida | |
| 2005/0107194 | A1* | 5/2005 | Oishi | F02B 75/16 474/28 |
| 2008/0223662 | A1* | 9/2008 | Sato | F01M 11/02 184/6.12 |
| 2008/0314687 | A1* | 12/2008 | Shiozaki | B62M 7/02 184/6.5 |
| 2009/0293850 | A1* | 12/2009 | Wilflinger | F02B 39/04 123/559.3 |
| 2010/0242895 | A1* | 9/2010 | Takiguchi | F01M 5/002 123/196 R |
| 2017/0088129 | A1* | 3/2017 | Iwasaki | B60W 30/025 |
| 2017/0167550 | A1 | 6/2017 | Fujimoto et al. | |

FOREIGN PATENT DOCUMENTS

| | | | |
|---|---|---|---|
| JP | H10-77936 | A | 3/1998 |
| JP | 2005-069145 | A | 3/2005 |
| JP | 2009-067336 | A | 4/2009 |
| JP | 2012-211553 | A | 11/2012 |
| JP | 2014-015919 | A | 1/2014 |
| JP | 2015-074384 | A | 4/2015 |
| JP | 2017-125432 | A | 7/2017 |

OTHER PUBLICATIONS

Official Communication dated Aug. 10, 2020 issued in the corresponding Indian Patent Application 201944026994.

* cited by examiner

INTERNAL COMBUSTION ENGINE

FIELD OF THE INVENTION

The present invention relates to an internal combustion engine comprising: a crankcase supporting a crankshaft rotatably about a rotation axis of the crankshaft, the crankcase accommodating therein a multi-speed transmission; a cylinder block joined to the crankcase, and having at least one cylinder axis that is located in a vertical plane orthogonal to the rotation axis and rises relative to a horizontal plane; a main shaft incorporated in the multi-speed transmission and rotatably supported on the crankcase, the main shaft coaxially supporting thereon a primary driven gear, which is in mesh with a primary drive gear of the crankshaft, and a one-way clutch gear, and; a reduction gear including, at one end thereof, a small-diameter gear in mesh with the one-way clutch gear and at an opposite end thereof, a large-diameter gear in mesh with a drive gear of a starter motor

DESCRIPTION OF THE RELATED ART

Japanese Patent Application Laid-open No. 10-77936 discloses an engine unit (internal combustion engine) mounted on a body frame of a two-wheeled motor vehicle. The engine unit includes a crankcase supporting a crankshaft rotatably about a rotation axis thereof and accommodating a transmission device (multi-speed transmission) therein. Joined to a crankcase is a cylinder block having cylinder axes that are located in a vertical plane orthogonal to a rotation axis of the crankshaft and rise relative to a horizontal plane.

The transmission device has a main shaft rotatably supported on the crankcase, and coaxially supporting thereon a primary driven gear, which is in mesh with a primary drive gear of the crankshaft, and a one-way clutch gear. A reduction gear of the starter motor is in mesh with the one-way clutch on the main shaft so that a driving force of the starter motor can be transmitted to the crankshaft via the primary driven gear.

SUMMARY OF THE INVENTION

In the engine unit described in Japanese Patent Application Laid-open No. 10-77936, a reentrant space formed between an upper part of the crankcase and a rear wall of the cylinder block is left as a dead space. There is, accordingly, a desire to efficiently dispose components there.

The present invention has been achieved in view of the above-mentioned circumstances, and it is an object thereof to provide an internal combustion engine that makes it possible to efficiently dispose components in a reentrant space formed between a crankcase and a cylinder block.

According to a first aspect of the present invention, there is provided an internal combustion engine comprising: a crankcase supporting a crankshaft rotatably about a rotation axis of the crankshaft, the crankcase accommodating therein a multi-speed transmission; a cylinder block joined to the crankcase, and having a cylinder axis that is located in a vertical plane orthogonal to the rotation axis and rises relative to a horizontal plane; a main shaft incorporated in the multi-speed transmission and rotatably supported on the crankcase, the main shaft coaxially supporting thereon a primary driven gear, which is in mesh with a primary drive gear of the crankshaft, and a one-way clutch gear, and; a reduction gear including, at one end thereof, a small-diameter gear in mesh with the one-way clutch gear and at an opposite end thereof, a large-diameter gear in mesh with a drive gear of a starter motor, wherein the starter motor has a driveshaft disposed below a rotation axis of the reduction gear and within a width of the large-diameter gear as viewed in an axial direction. That is, the starter motor has the driveshaft with an axis thereof disposed below the rotation axis of the reduction gear and in a space sandwiched between a first vertical plane, which is parallel to the rotation axis of the crankshaft and circumscribes the large-diameter gear from one direction, and a second vertical plane, which is parallel to the first vertical plane and circumscribes the large-diameter gear from an other direction.

With the first aspect, the starter motor and the reduction gear are placed side by side in a longitudinal direction, and therefore the starter motor can be efficiently disposed in the reentrant space formed between the crankcase and the cylinder block.

According to a second aspect of the present invention, in addition to the first aspect, the driveshaft has an axis disposed within a width of the small-diameter gear as viewed in the axial direction. That is, the driveshaft has the axis disposed in a space sandwiched between a third vertical plane, which is parallel to the rotation axis of the crankshaft and circumscribes the small-diameter gear from one direction, and a fourth vertical plane, which is parallel to the third vertical plane and circumscribes the small-diameter gear from an other direction.

With the second aspect, the starter motor and the reduction gear are placed side by side in the longitudinal direction to a maximum extent possible, and therefore the starter motor can be more efficiently disposed in the reentrant space formed between the crankcase and the cylinder block.

According to a third aspect of the present invention, in addition to the first aspect t, there is provided the internal combustion engine, further comprising: a clutch connected to the primary driven gear on the main shaft and switching between transmission and non-transmission of a driving force of the crankshaft, wherein the driveshaft has an axis disposed inside an imaginary cylindrical plane that is coaxial with the main shaft and circumscribes the clutch.

With the third aspect, the axis of the driveshaft of the starter motor is located in the space surrounded by the imaginary cylindrical plane that is coaxial with the main shaft and circumscribes the clutch, and therefore the starter motor can be disposed in a compact configuration in the reentrant space formed between the crankcase and the cylinder block.

According to a fourth aspect of the present invention, in addition to the third aspect, the rotation axis of the reduction gear is disposed outside the imaginary cylindrical plane.

With the fourth aspect, the starter motor and the reduction gear are placed side by side in the longitudinal direction, and therefore the starter motor can be efficiently disposed in the reentrant space formed between the crankcase and the cylinder block.

According to a fifth aspect of the present invention, in addition to the first aspect, the crankcase has an upper wall part, which covers the main shaft while bulging out along an imaginary cylindrical plane that is coaxial with the main shaft, whereby a reentrant space is formed between the crankcase and the cylinder block, and the starter motor is disposed in the reentrant space.

With the fifth aspect, the starter motor can be efficiently disposed in a dead space defined between the upper wall part of the crankcase and the cylinder block.

According to a sixth aspect of the present invention, in addition to the fifth aspect, the crankcase has a thickened portion surrounding a cylinder, which guides a piston, while bulging out toward the starter motor.

With the sixth aspect, the starter motor and the reduction gear are disposed in the longitudinal direction, and therefore a space sufficient to dispose the thickened portion can be left in the reentrant space formed between the crankcase and the cylinder block.

According to a seventh aspect of the present invention, in addition to the first aspect, there is provided the internal combustion engine, further comprising: a canister disposed above the starter motor at a location offset from the reduction gear in an axial direction of the main shaft.

With the seventh aspect, the starter motor and the reduction gear are disposed in the longitudinal direction, and therefore a space is created above the starter motor and behind the reduction gear and a canister having a sufficient volume can be efficiently disposed in the space.

According to an eighth aspect of the present invention, in addition to the first aspect, the starter motor has a flange outwardly extending in a horizontal direction from a cylindrical outer surface of the starter motor and fixed on the crankcase.

With the eighth aspect, the starter motor can be disposed closer to a bottom of the reentrant space compared with a case where a flange extends upward or downward in a vertical direction from the outer surface, and therefore the starter motor as a heavy component can be placed closer toward a center of the internal combustion engine, thereby making it possible to contribute to mass centralization.

The above and other objects, characteristics and advantages of the present invention will be clear from detailed descriptions of the preferred embodiment, which will be provided below while referring to the attached drawings.

DESCRIPTION OF THE PREFERRED EMBODIMENT

With reference to the attached drawings, an embodiment of the present invention will be described hereinafter. Here, the up/down, front/rear and left/right of a vehicle body are assumed to be defined based on the level of the eyes of a passenger riding a two-wheeled motor vehicle.

Figure 1:
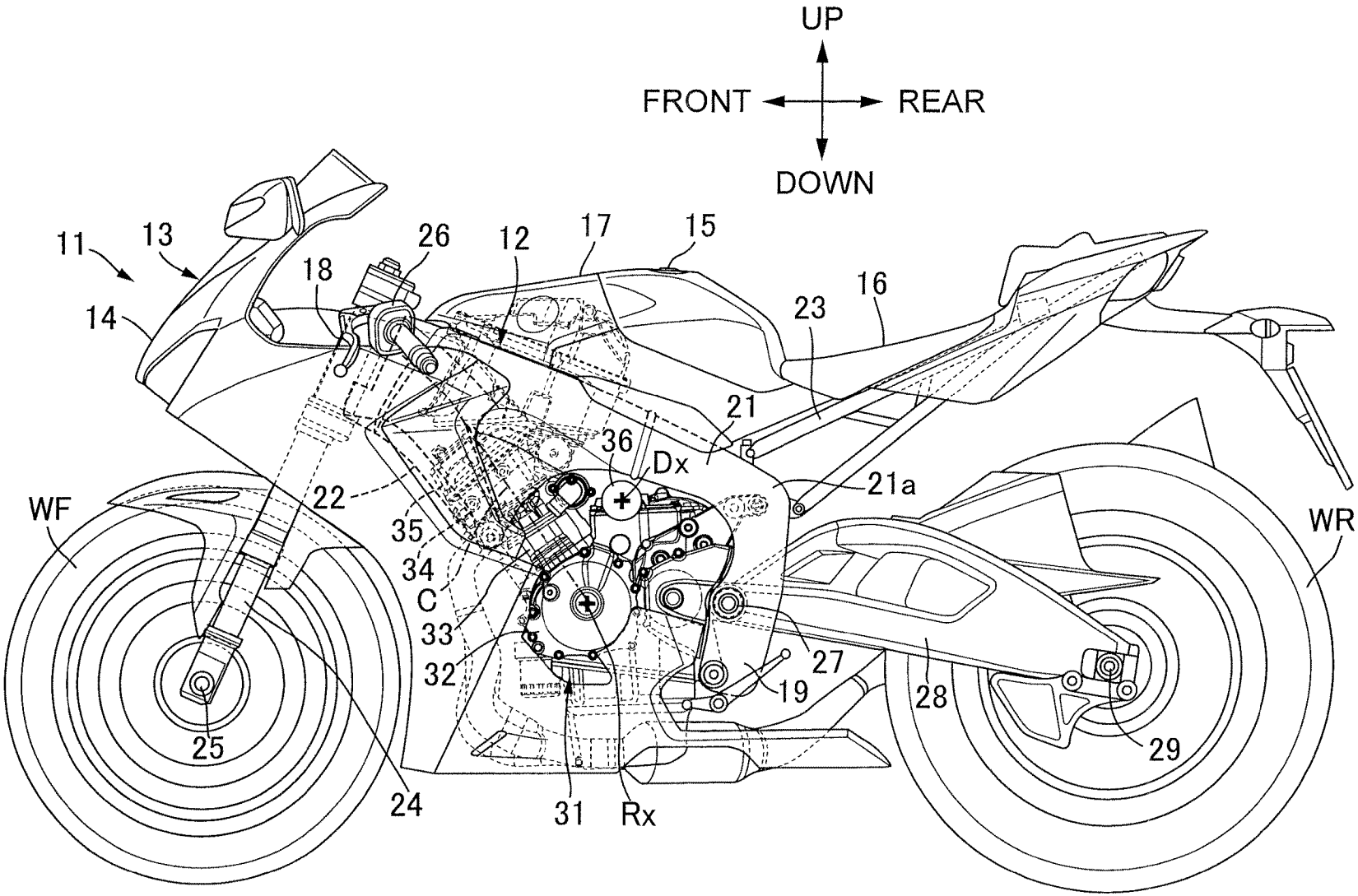
FIG. 1 is a side view schematically depicting the overall configuration of a two-wheeled motor vehicle according to an embodiment.

FIG. 1 schematically depicts an overall image of the two-wheeled motor vehicle as a saddle-ridden vehicle according to the embodiment of the present invention. The two-wheeled motor vehicle 11 includes a body frame 12 and a body cover 13 attached to the body frame 12. The body cover 13 has a front cowl 14 and a tank cover 17. The front cowl 14 covers the body frame 12 from the front thereof. The tank cover 17 continues forward from an outer surface of a fuel tank 15, and is joined to a passenger's seat 16 at a rear of the fuel tank 15. In the fuel tank 15, fuel is stored. Upon operating the two-wheeled motor vehicle 11, a passenger straddles the passenger's seat 16.

The body frame 12 has a head pipe 18, a pair of left and right main frames 21 extending rearwardly downward from the head pipe 18 and having pivot frames 19 at lower rear ends thereof, respectively, a down frame 22 extending, at a location below the main frames 21, downwardly from the head pipe 18 and integrated with the main frames 21, and left and right seat frames 23 extending rearwardly upward from curved areas 21*a* of the main frames 21, respectively, and constructing a truss structure. The passenger's seat 16 is supported on the seat frames 23.

A front fork 24 is steerably supported on the head pipe 18. On the front fork 24, a front wheel WF is supported rotatably about an axle 25. A steering handlebar 26 is connected to an upper end of the front fork 24. Upon operating the two-wheeled motor vehicle 11, a rider holds grips on left and right ends of the steering handlebar 26.

In a rear section of the two-wheeled motor vehicle 11, a swingarm 28 is connected to the body frame 12 so that the swingarm 28 is swingable up and down about a pivot 27. On a rear end of the swingarm 28, a rear wheel WR is supported rotatably about an axle 29. Between the front wheel WF and the rear wheel WR, an internal combustion engine 31 is mounted on the body frame 12 to generate a driving force which is to be transmitted to the rear wheel WR. The power of the internal combustion engine 31 is transmitted to the rear wheel WR via a power transmission device 69 (see FIG. 3).

The internal combustion engine 31 includes a crankcase 32, a cylinder block 33, a cylinder head 34, and a head cover 35. The crankcase 32 is s disposed between the down frame 22 and the main frames 21, is joined to and supported on the down frame 22 and the main frames 21, respectively, and outputs power about a rotation axis Rx. The cylinder block 33 has cylinder axes C that are located in a vertical plane orthogonal to the rotation axis Rx and rise relative to a horizontal plane. The cylinder head 34 is joined to an upper end of the cylinder block 33, and supports a valve mechanism. The head cover 35 is joined to an upper end of the cylinder head 34, and covers the valve mechanism on the cylinder head 34.

The two-wheeled motor vehicle 11 includes a canister 36, which is disposed below the fuel tank 15, above the crankcase 32 and behind the cylinder block 33, is connected with the fuel tank 15, and holds fuel vapor gas occurred from the fuel tank 15. The canister 36 has a center axis Dx extending parallel to the rotation axis Rx in a vehicle width direction, and has a cylindrical body defining a space in which activated carbon is held. Therefore, the canister 36 has an external shape formed in a columnar shape.

Figure 2:
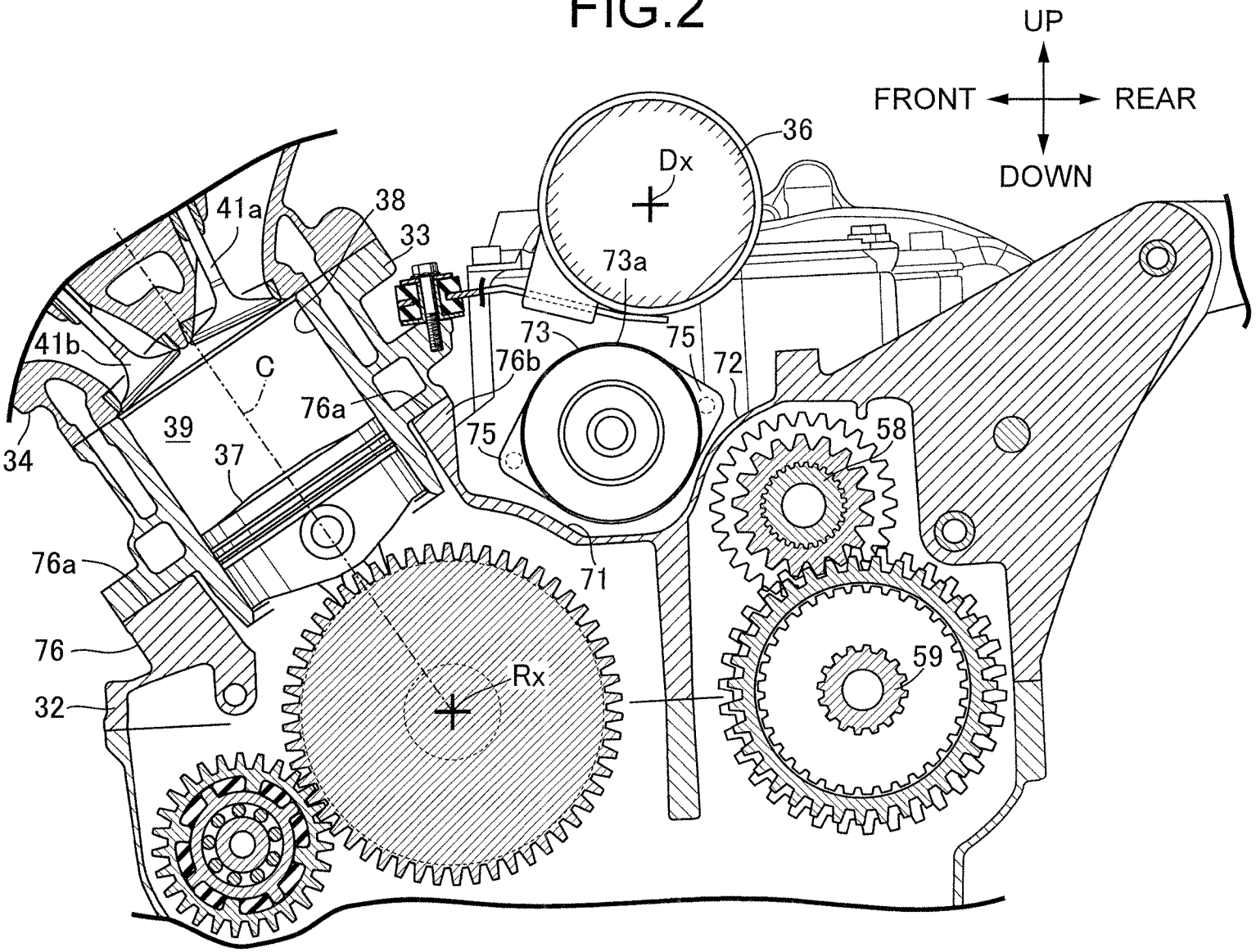
FIG. 2 is an enlarged side view schematically depicting surroundings of an internal combustion engine as observed on a vertical section.

As depicted in FIG. 2, the cylinder block 33 includes cylinders 38 formed therein to guide linear reciprocating motion of pistons 37 along the cylinder axes C, respectively. In this embodiment, the as many as four cylinders 38 are formed side by side along the rotation axis Rx in the cylinder block 33, so that the internal combustion engine 31 has a so-called in-line four-cylinder configuration. Between the pistons 37 and the cylinder head 34, combustion chambers 39 are defined, respectively. By the functions of intake valves 41*a* and exhaust valves 41*b* that open and close according to the rotation of the camshaft, an air-fuel mixture is introduced into the combustion chambers 39, and subsequent to combustion, the resulting exhaust gas is discharged from the combustion chamber 39.

Figure 3:
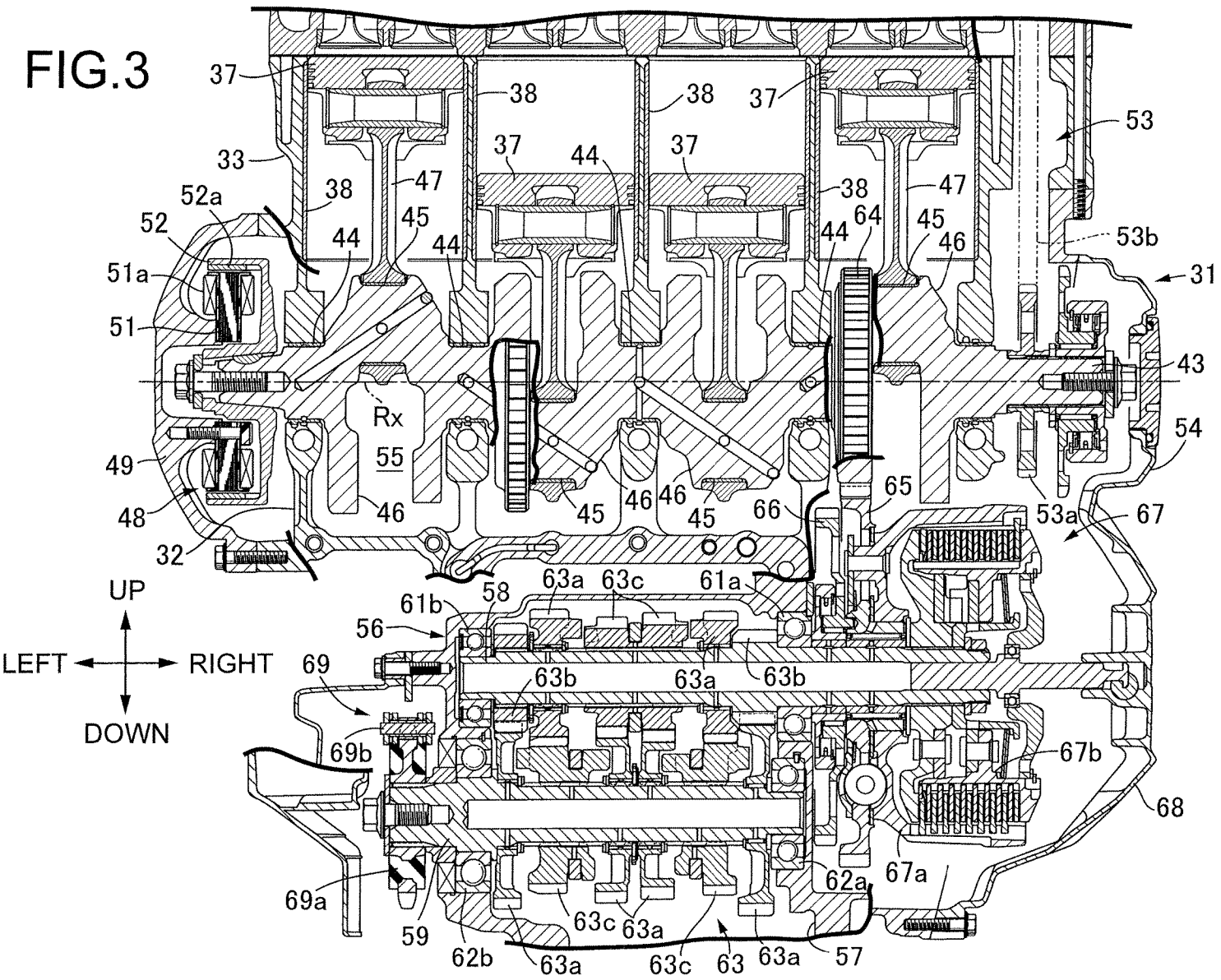
FIG. 3 is an enlarged sectional view of the internal combustion engine, which schematically depicts a structure as observed on a section including a rotation axis of a crankshaft and axes of a main shaft and a counter shaft.

As depicted in FIG. 3, a crankshaft 43 is supported rotatably about the rotation axis Rx on the crankcase 32. The crankshaft 43 includes journals 44 connected to sliding bearings, respectively, and cranks 46 disposed between the adjacent journals 44, respectively, and having crankpins 45 extending parallel to the rotation axis Rx and connecting associated crankwebs with each other. Connecting rods 47 extend from the pistons 37, respectively, and are rotatably connected at enlarged end portions thereof to the associated crankpins 45. The connecting rods 47 convert linear reciprocating motion of the associated pistons 37 to rotational motion of the crankshaft 43.

The crankshaft 43 projects out at one end thereof from a left side surface of the crankcase 32. An alternating current generator (ACG) 48 is connected to the one end of the crankshaft 43. On the left side surface of the crankcase 32, an ACG cover 49 is joined to accommodate the ACG 48 between the crankcase 32 and the ACG cover 49. The ACG 48 has a stator 51 fixed on the ACG cover 49, and a rotor 52 connected to the one end of the crankshaft 43 projecting out from the crankcase 32, so that the rotor 52 and the crankshaft 43 are incapable of rotation relative to each other. The stator 51 has a plurality of coils 51*a* arrayed in a peripheral direction about the crankshaft 43 and wound on stator cores, respectively. The rotor 52 has a plurality of magnets 52*a* arrayed in a peripheral direction along an annular track that surrounds the stator 51. When the crankshaft 43 rotates, the magnets 52*a* undergo relative displacement to the coils 51*a* so that the ACG 48 generates electricity.

The crankshaft 43 projects out at an opposite end thereof from a right side surface of the crankcase 32. To the opposite end of the crankshaft 43, a cam drive mechanism 53 is connected to transmit power to a camshaft. The cam drive mechanism 53 includes a drive cam gear 53*a* coaxially fixed on the crankshaft 43, a driven cam gear (not depicted) fixed on the camshaft, and a cam gear train 53*b* constructed of a plurality of gears and configured to mesh with the drive cam gear 53*a* and the driven cam gear sequentially in this order to transmit power from the drive cam gear 53*a* to the driven cam gear. On the right side surface of the crankcase 32, a cam drive mechanism cover 54 is joined to accommodate the drive cam gear 53*a* between the crankcase 32 and the cam drive mechanism cover 54. The ACG cover 49 and the cam drive mechanism cover 54 cover an outer surface of the crankcase 32 to define a crank chamber 55 that accommodates the crankshaft 43 therein. The cam drive mechanism 53 may include a drive sprocket, driven sprocket and cam chain in place of the drive cam gear 53*a*, driven cam gear and cam gear train 53*b*.

A multi-speed transmission of the dog clutch type (hereinafter "the transmission") 56 is incorporated in the internal combustion engine 31. The transmission 56 is accommodated in a transmission case 57 defined in the crankcase 32 and continuing from the crank chamber 55. The transmission 56 includes a main shaft 58 and a counter shaft 59, which have axes parallel to the axis of the crankshaft 43. The main shaft 58 and counter shaft 59 are rotatably supported on the crankcase 32 via rolling bearings 61*a*, 61*b*, 62*a*, and 62*b*.

On the main shaft 58 and counter shaft 59, a plurality of transmission gears 63 are supported. The transmission gears 63 supported on the main shaft 58 are disposed between the bearings 61*a* and 61*b*, while the transmission gears 63 supported on the counter shaft 59 are disposed between the bearings 62*a* and 62*b*. The transmission gears 63 are accommodated in the transmission case 57. The transmission gears 63 include rotation gears 63*a* coaxially supported for relative rotation on the main shaft 58 and the counter shaft 59, respectively, stationary gears 63*b* fixed on the main shaft 58 for non-rotation relative to each other and meshable with the corresponding rotation gears 63*a*, and shift gears 63*c* supported on the main shaft 58 and the counter shaft 59, respectively, for non-rotation relative to each other and for axial displacement and meshable with the corresponding rotation gears 63*a*. Axial displacement of the rotation gears 63*a* and stationary gears 63*b* is restricted. When the shift gear 63*c* is connected to the corresponding rotation gear 63*a* due to axial displacement, relative rotation between the rotation gear 63*a* and the main shaft 58 or counter shaft 59 is restricted. When the shift gear 63*c* meshes with the corresponding stationary gear 63*b*, rotating power is transmitted between the main shaft 58 and the counter shaft 59. When the shift gear 63*c* is connected to the rotation gear 63*a* meshing with the corresponding stationary gear 63*b*, rotating power is transmitted between the main shaft 58 and the counter shaft 59. Through meshing of particular transmission gears 63 between the main shaft 58 and the counter shaft 59 as described above, rotating power is transmitted at a specified reduction ratio from the main shaft 58 to the counter shaft 59.

The main shaft 58 projects out at one end thereof from the right side surface of the crankcase 32. Outside the crankcase 32, a primary driven gear 65 and a one-way clutch gear 66 are coaxially supported for relative rotation on the one end of the main shaft 58. The primary driven gear 65 is in mesh with a primary drive gear 64 of the crankshaft 43, and the one-way clutch gear 66 is connected to the primary driven gear 65. The primary drive gear 64 is formed, for example, integrally with the crank 46 of the crankshaft 43. The one-way clutch gear 66 applies a rotational force to the primary driven gear 65 upon rotation in one direction according to an external force acting from its gear teeth, but rotates relative to the primary driven gear 65 and remains in a stationary state on the main shaft 58 upon rotation of the primary driven gear 65 according to a drive force from the crankshaft 43.

On the main shaft 58, a friction clutch 67 (as a clutch) is connected to the primary driven gear 65. To the right side surface of the crankcase 32, a clutch cover 68 is joined to accommodate the friction clutch 67 between the crankcase 32 and the clutch cover 68. The friction clutch 67 includes a clutch outer 67*a* and a clutch hub 67*b*. The primary driven gear 65 is connectable to the clutch outer 67*a*. According to the operation of a clutch lever, connection and disconnection are switched between the clutch outer 67*a* and the clutch hub 67*b* in the friction clutch 67.

To the counter shaft 59, a drive sprocket 69*a* of the power transmission device 69 disposed outside the crankcase 32 is connected. A drive chain 69*b* is wrapped around the drive sprocket 69*a*. The drive chain 69*b* transmits rotating power of the drive sprocket 69*a* to the rear wheel WR.

As depicted in FIG. 2, the crankcase 32 has an upper wall part 72 forming a reentrant space 71 between the upper wall part 72 and the cylinder block 33, the upper wall part 72 covering the main shaft 58 while bulging out along an imaginary cylindrical plane that is coaxial with the main shaft 58. In the reentrant space 71, a starter motor 73 is disposed below the canister 36.

The starter motor 73 includes a cylindrical housing 73*a* having a central axis in parallel with the rotation axis Rx. The housing 73*a* accommodates a rotor and a stator, the rotor being connected to a driveshaft having an axis on the central axis, and the stator surrounding the rotor. The housing 73*a* has a pair of flanges 75 outwardly extending in horizontal directions from a cylindrical outer surface. The flanges 75 are fixedly secured on the crankcase 32 by bolt members having axes that are parallel to the central axis.

On the crankcase 32, a base 76 is formed, and a mating face 76*a* which is mated with the cylinder block 33 is formed on the base 76. The base 76 defines cylindrical cavities for receiving cylinder liners which guide linear reciprocating motion of the associated pistons 37. The base 76 has a thickened portion 76*b* that bulges out toward the starter motor 73 side while surrounding the cylinders 38. The thickened portion 76*b* continues from the upper wall part 72, and a thickness of the thickened portion 76*b* becomes larger than a thickness of the upper wall 72 in going toward the mating face 76*a*.

Figure 4:
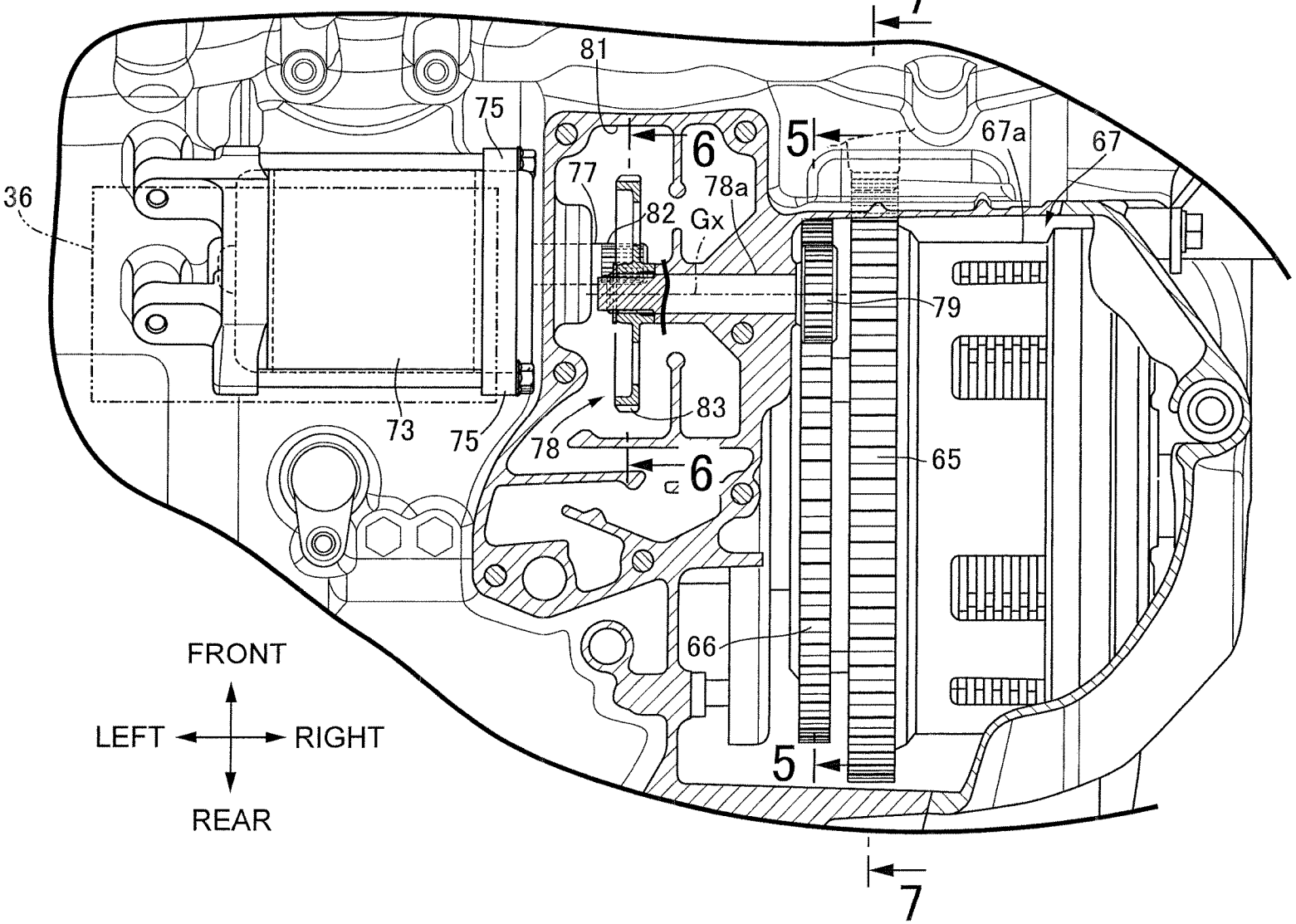
FIG. 4 is a top view of the internal combustion engine, which includes in a part thereof a section taken along a horizontal plane.
Figure 5:
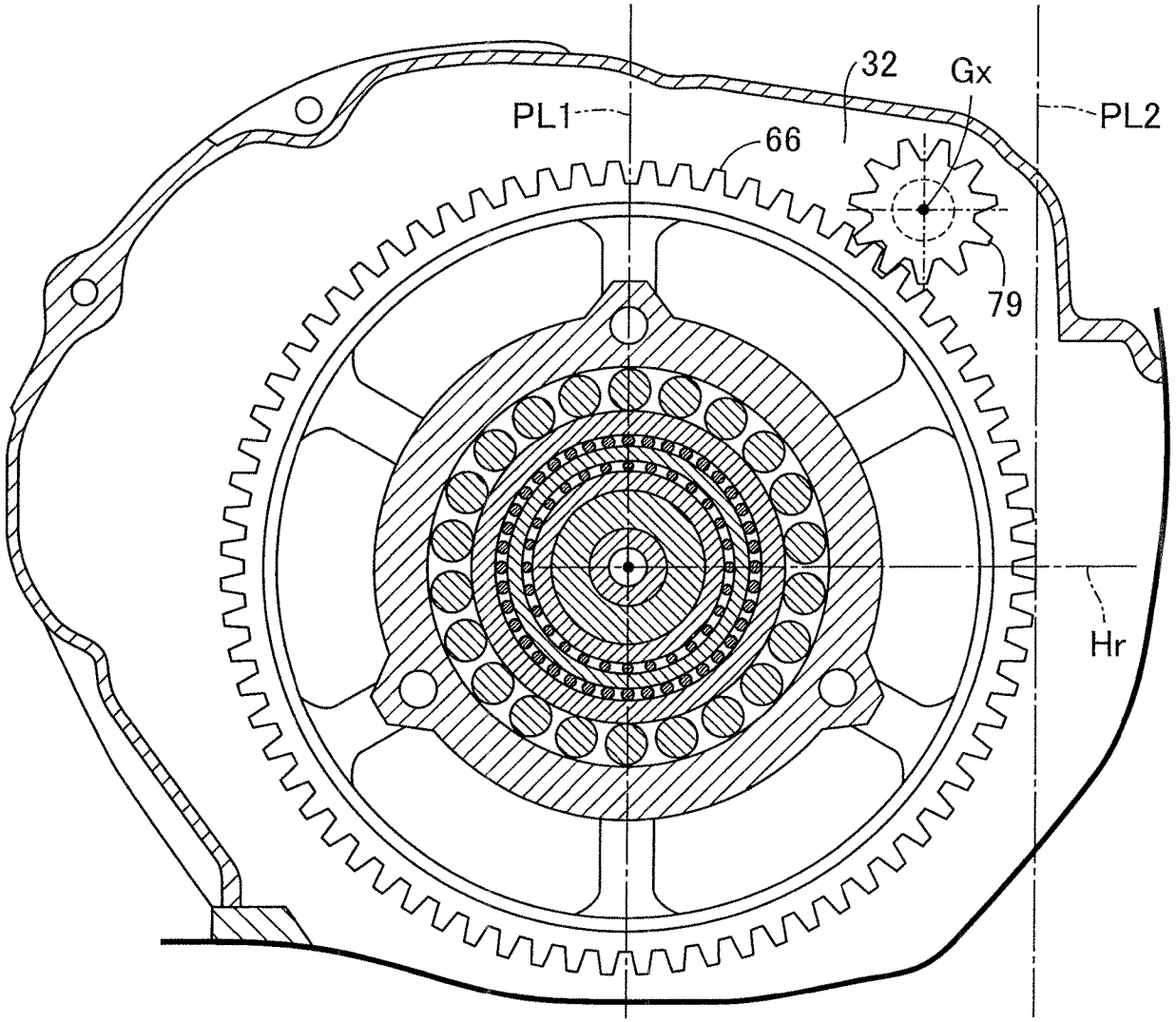
FIG. 5 is an enlarged vertical sectional view along line 5-5 of FIG. 4.

As depicted in FIG. 4, the driveshaft 77 of the stator motor 73 is connected to the one-way clutch 66 via a reduction gear 78. The reduction gear 78 includes a shaft body 78*a* supported rotatably about a rotation axis Gx of the reduction gear 78 on the crankcase 32. As depicted in FIG. 5, a small-diameter gear 79 is fixed on one end of the shaft body 78*a*, coaxially with shaft body 78*a*, and in mesh with the one-way clutch gear 66 outside the crankcase 32. Above a horizontal plane Hr in which a rotation axis of the one-way clutch gear 66 is included, the small-diameter gear 79 is accommodated between a perpendicular plane PL1, in which the rotation axis of the one-way clutch gear 66 is included, and a perpendicular plane PL2, which circumscribes the one-way clutch gear 66 from the front.

Figure 6:
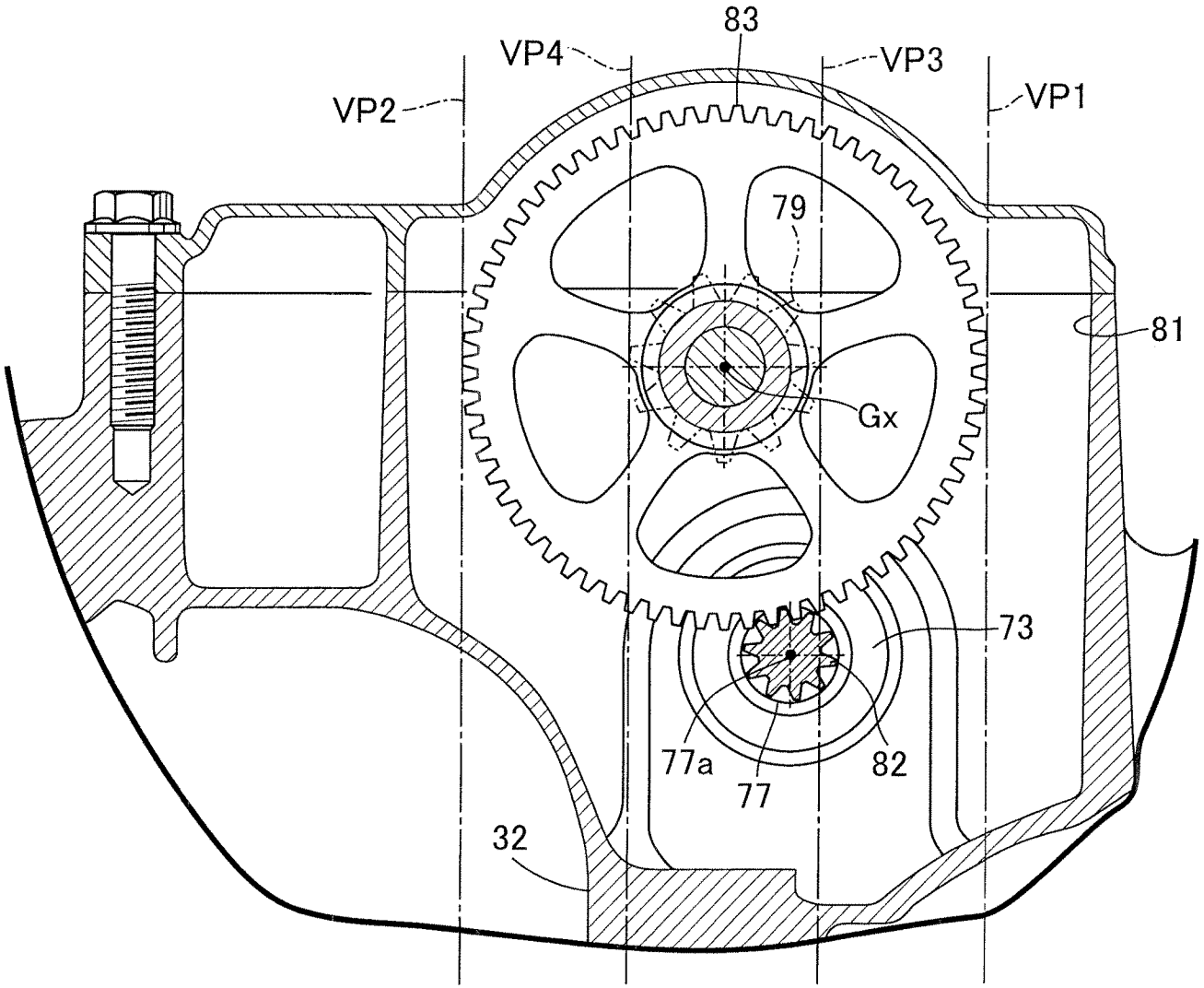
FIG. 6 is an enlarged vertical sectional view along line 6-6 of FIG. 4.

As depicted in FIG. 6, a large-diameter gear 83 is formed on an opposite end of the shaft body 78*a*, coaxially with the shaft body 78*a*, and in mesh with a drive gear 82 of the starter motor 73 in a gear compartment 81. The drive gear 82 is cut, for example, on the driveshaft 77 of the starter motor 73. Rotation of the driveshaft 77 is reduced at the reduction gear 78, and then transmitted to the one-way clutch gear 66. The starter motor 73 generates a driving force that forcedly rotates the crankshaft 43. As depicted in FIG. 4, the canister 36 is disposed above the starter motor 73 at a location offset from the gear compartment 81 in an axial direction of the main shaft 58.

In this embodiment, the driveshaft 77 of the starter motor 73 is disposed below the rotation axis Gx of the reduction gear 78 and within a width of the large-diameter gear 83 as viewed in the axial direction. In other words, the driveshaft 77 of the starter motor 73 has the axis 77*a* disposed below the rotation axis Gx of the reduction gear 78 and in a space sandwiched between a first vertical plane VP1, which is parallel to the rotation axis Rx of the crankshaft 43 and circumscribes the large-diameter gear 83 from one direction (the front), and a second vertical plane VP2, which is parallel to the first vertical plane VP1 and circumscribes the large-diameter gear 83 from an other direction (the rear). In addition, the axis 77*a* of the driveshaft 77 is disposed within the width of the small-diameter gear 79 as viewed in the axial direction. In other words, the axis 77*a* of the driveshaft 77 is located in a space sandwiched between a third vertical plane VP3, which is parallel to the rotation axis Rx of the crankshaft 43 and circumscribes the small-diameter gear 79 from one direction (the front), and a fourth vertical plane VP4, which is parallel to the third vertical plane VP3 and circumscribes the small-diameter gear 79 from an other direction (the rear).

Figure 7:
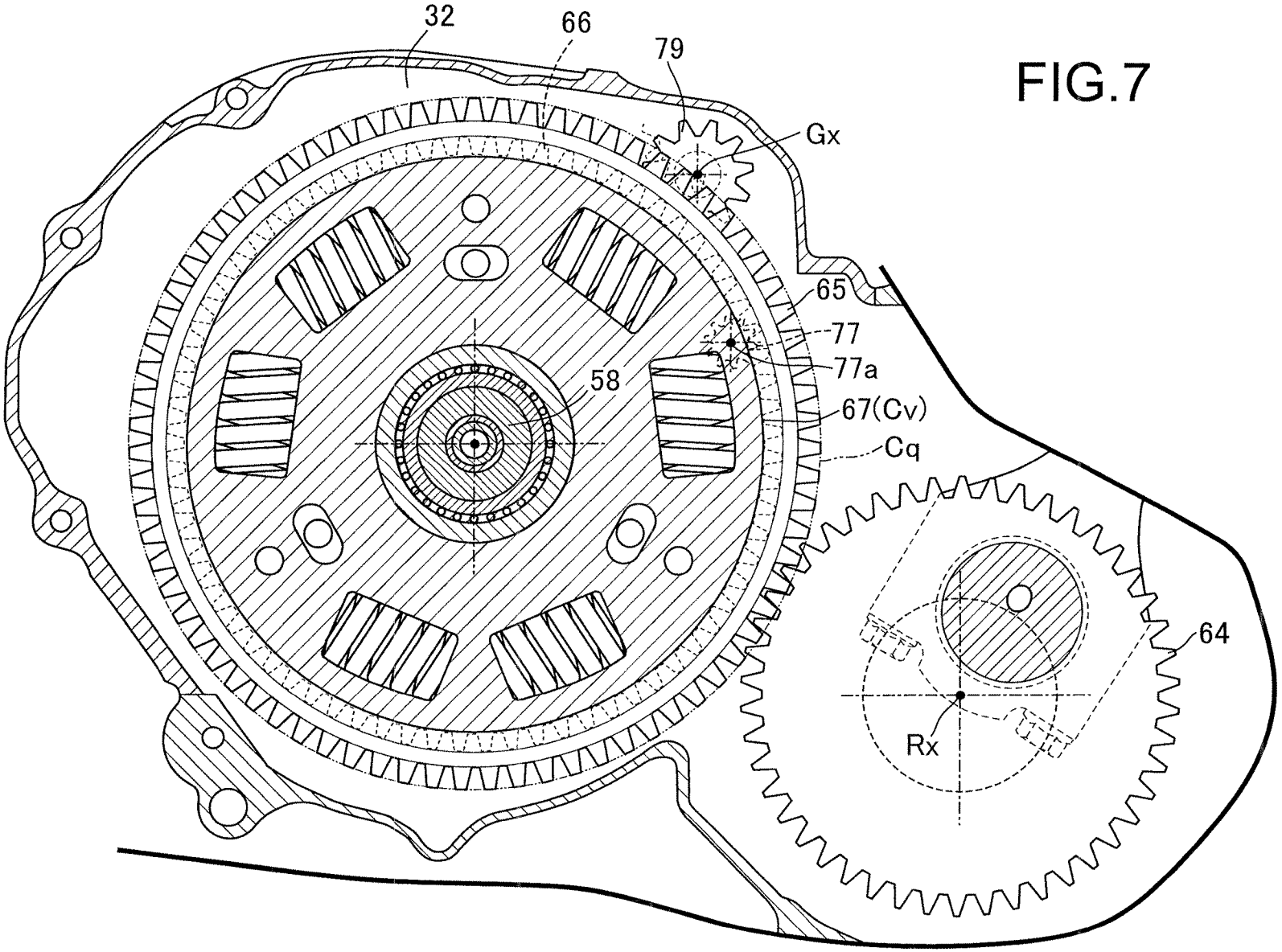
FIG. 7 is an enlarged vertical sectional view along line 7-7 of FIG. 4.

As depicted in FIG. 7, the primary driven gear 65 has an external diameter formed greater than an external diameter of the one-way clutch gear 66 that is in mesh with the small-diameter gear 79 at external teeth of both the gears. The rotation axis Gx of the reduction gear 78 is disposed outside an imaginary cylindrical plane Cv, which is coaxial with the main shaft 58 and circumscribes the friction clutch 67. In this embodiment, the rotation axis Gx of the reduction gear 78 is also disposed outside an imaginary cylindrical plane Cq, which is coaxial with the main shaft 58 and circumscribes the primary driven gear 65. The driveshaft 77 of the starter motor 73 has the axis 77*a* disposed inside the imaginary cylindrical plane Cv.

The operation of this embodiment will next be described. When electric power is supplied to the starter motor 73 upon starting the internal combustion engine 31, the driveshaft 77 rotates in a specified direction about the axis 77*a*. The rotation of the driveshaft 77 is transmitted to the large-diameter gear 83 of the reduction gear 78. As the large-diameter gear 83 has a number of teeth significantly greater than the drive gear 82, the reduction gear 78 rotates at a lower speed than the driveshaft 77. The rotation of the reduction gear 78 is transmitted from the small-diameter gear 79 to the one-way clutch gear 66. As the one-way clutch gear 66 has a significantly greater number of teeth than the small-diameter gear 79, the one-way clutch gear 66 rotates at a lower speed than the reduction gear 78.

The one-way clutch gear 66 rotates together with the primary driven gear 65 on the main shaft 58. The rotation of the primary driven gear 65 is transmitted from the primary drive gear 64 to the crankshaft 43. The crankshaft 43 is forcedly rotated in a specified direction. Combustion starts in the combustion chambers 39, and the pistons 37 start linear reciprocating motion in the cylinders 38. The operation of the starter motor 73 is now ended.

When the linear reciprocating motion of the pistons 37 is started according to the combustion operation, rotational motion is transmitted from the primary drive gear 64 to the clutch outer 67*a* via the primary driven gear 65. The rotation of the primary driven gear 65 is not transmitted to the one-way clutch gear 66, and therefore the one-way clutch gear 66 remains in a stationary state on the main shaft 58. Hence, loading on the starter motor 73 is avoided during operation of the internal combustion engine 31.

In this embodiment, the driveshaft 77 of the starter motor 73 is disposed below the rotation axis Gx of the reduction gear 78 and within the width of the large-diameter gear 83 as viewed in the axial direction. Specifically, the driveshaft 77 of the starter motor 73 has the axis 77*a* disposed in the space sandwiched between the first vertical plane VP1, which is parallel to the rotation axis Rx of the crankshaft 43 and circumscribes the large-diameter gear 83 from one direction (the front), and the second vertical plane VP2, which is parallel to the first vertical plane VP1 and circumscribes the large-diameter gear 83 from an other direction (the rear). The starter motor 73 and the reduction gear 78 are placed side by side in the longitudinal direction, and therefore the starter motor 73 is efficiently disposed in the reentrant space 71 formed between the crankcase 32 and the cylinder block 33.

In particular, the axis 77*a* of the driveshaft 77 is disposed within the width of the small-diameter gear 79 as viewed in the axial direction. That is, the axis 77*a* of the driveshaft 77 is located in the space sandwiched between the third vertical plane VP3, which is parallel to the rotation axis Rx of the crankshaft 43 and circumscribes the small-diameter gear 79 from one direction (the front), and the fourth vertical plane VP4, which is parallel to the third vertical plane VP3 and circumscribes the small-diameter gear 79 from an other direction (the rear). The starter motor 73 and the reduction gear 78 are, therefore, placed side by side in the longitudinal direction to a maximum extent possible, and the starter motor 73 is more efficiently disposed in the reentrant space 71 formed between the crankcase 32 and the cylinder block 33.

Further, the axis 77*a* of the driveshaft 77 is disposed inside the imaginary cylindrical plane Cv, which is coaxial with the main shaft 58 and circumscribes the friction clutch 67. The axis 77*a* of the driveshaft 77 is located in the space surrounded by the imaginary cylindrical plane Cv as described above, so that the starter motor 73 is disposed in a compact configuration in the reentrant space 71 formed between the crankcase 32 and the cylinder block 33.

In this embodiment, the rotation axis Gx of the reduction gear 78 is disposed outside the imaginary cylindrical plane Cv. As the starter motor 73 and the reduction gear 78 are placed side by side in the longitudinal direction, the starter motor 73 is efficiently disposed in the reentrant space 71 formed between the crankcase 32 and the cylinder block 33.

The crankcase 32 has the upper wall part 72, which covers the transmission gear 63 on the main shaft 58 while bulging out along the imaginary cylindrical plane that is coaxial with the main shaft 58, and which forms the reentrant space 71 between the upper wall part 72 and the cylinder block 33. The starter motor 73 is disposed in the reentrant space 71. The starter motor 73 is efficiently disposed in the dead space defined between the upper wall part 72 of the crankcase 32 and the cylinder block 33.

The crankcase 32 has the thickened portion 76*b* that bulges out toward the starter motor 73 side while surrounding the cylinders 38 that guide the associated pistons 37. The starter motor 73 and the reduction gear 78 are disposed in the longitudinal direction, and therefore a space sufficient to dispose the thickened portion 76*b* therein is left in the reentrant space 71 formed between the crankcase 32 and the cylinder block 33.

In the two-wheeled motor vehicle 11 according to this embodiment, the canister 36 is disposed above the starter motor 73 at the location offset from the gear compartment 81 of the reduction gear 78 in the axial direction of the main shaft 58. As the starter motor 73 and the reduction gear 78 are disposed in the longitudinal direction, the space is formed above the starter motor 73 and behind the gear compartment 81 and the canister 36 which has a sufficient volume is efficiently disposed in the space.

The starter motor 73 has the flanges 75, which outwardly extend in the horizontal directions from the cylindrical outer surface and are fixed on the crankcase 32. The starter motor 73 is disposed closer to the bottom of the reentrant space 71 compared with a case where flanges extend upward or downward in the vertical direction from the outer surface, and therefore the starter motor 73 as a heavy component is placed closer toward a center of the internal combustion engine 31, thereby contributing to mass centralization.

What is claimed is:

1. An internal combustion engine comprising:

a crankcase supporting a crankshaft rotatably about a rotation axis of the crankshaft, the crankcase accommodating therein a multi-speed transmission;

a cylinder block joined to the crankcase, and having a cylinder axis that is located in a vertical plane orthogonal to the rotation axis and rises relative to a horizontal plane;

a main shaft incorporated in the multi-speed transmission and rotatably supported on the crankcase, the main shaft coaxially supporting thereon a primary driven gear, which is in mesh with a primary drive gear of the crankshaft, and a one-way clutch gear;

a reduction gear including, at one end thereof, a small-diameter gear in mesh with the one-way clutch gear and at an opposite end thereof, a large-diameter gear in mesh with a drive gear of a starter motor; and a clutch connected to the primary driven gear on the main shaft and switching between transmission and non-transmission of a driving force of the crankshaft, wherein the reduction gear has a shaft body which is rotatably supported at an intermediate portion thereof on the crankcase and extends in an axial direction of the crankshaft, the shaft body being fixed, at one end thereof, with the small-diameter gear and, at an opposite end thereof, with the large-diameter gear, the starter motor being opposed to the primary driven gear with the reduction gear interposed therebetween, wherein the starter motor has a driveshaft disposed below a rotation axis of the reduction gear and within a width of the large-diameter gear as viewed in an axial direction, and wherein the driveshaft has an axis disposed inside an imaginary cylindrical plane that is coaxial with the main shaft and circumscribes the clutch.

2. The internal combustion engine according to claim 1, wherein the driveshaft has an axis disposed within a width of the small-diameter gear as viewed in the axial direction.

3. The internal combustion engine according to claim 1, wherein the rotation axis of the reduction gear is disposed outside the imaginary cylindrical plane.

4. The internal combustion engine according claim 1, wherein the crankcase has an upper wall part, which covers the main shaft while bulging out along an imaginary cylindrical plane that is coaxial with the main shaft, whereby a reentrant space is formed between the crankcase and the cylinder block, and the starter motor is disposed in the reentrant space.

5. The internal combustion engine according to claim 4, wherein the crankcase has a thickened portion surrounding a cylinder, which guides a piston, while bulging out toward the starter motor.

6. The internal combustion engine according to claim 1, wherein the starter motor has a flange outwardly extending in a horizontal direction from a cylindrical outer surface of the starter motor and fixed on the crankcase.

7. An internal combustion engine comprising:

a crankcase supporting a crankshaft rotatably about a rotation axis of the crankshaft, the crankcase accommodating therein a multi-speed transmission;

a cylinder block joined to the crankcase, and having a cylinder axis that is located in a vertical plane orthogonal to the rotation axis and rises relative to a horizontal plane;

a main shaft incorporated in the multi-speed transmission and rotatably supported on the crankcase, the main shaft coaxially supporting thereon a primary driven gear, which is in mesh with a primary drive gear of the crankshaft, and a one-way clutch gear;

a reduction gear including, at one end thereof, a small-diameter gear in mesh with the one-way clutch gear and at an opposite end thereof, a large-diameter gear in mesh with a drive gear of a starter motor; and a clutch connected to the primary driven gear on the main shaft and switching between transmission and non-transmission of a driving force of the crankshaft, wherein the starter motor has a driveshaft disposed below a rotation axis of the reduction gear and within a width of the large-diameter gear as viewed in an axial direction, wherein a canister is disposed above the starter motor at a location offset from the reduction gear in an axial direction of the main shaft, and wherein the driveshaft has an axis disposed inside an imaginary cylindrical plane that is coaxial with the main shaft and circumscribes the clutch.

8. The internal combustion engine according to claim 7, wherein the driveshaft has an axis disposed within a width of the small-diameter gear as viewed in the axial direction.

9. The internal combustion engine according to claim 8, wherein the rotation axis of the reduction gear is disposed outside the imaginary cylindrical plane.

10. The internal combustion engine according claim 7, wherein the crankcase has an upper wall part, which covers the main shaft while bulging out along an imaginary cylindrical plane that is coaxial with the main shaft, whereby a reentrant space is formed between the crankcase and the cylinder block, and the starter motor is disposed in the reentrant space.

11. The internal combustion engine according to claim 10, wherein the crankcase has a thickened portion surrounding a cylinder, which guides a piston, while bulging out toward the starter motor.

12. The internal combustion engine according to claim 7, wherein the starter motor has a flange outwardly extending in a horizontal direction from a cylindrical outer surface of the starter motor and fixed on the crankcase.

* * * * *